United States Patent [19]

Downie

[11] Patent Number: 5,005,796

[45] Date of Patent: Apr. 9, 1991

[54] CHART CLIP

[76] Inventor: Yasmin J. Downie, P.O. Box 97088, Tacoma, Wash. 98497

[21] Appl. No.: 475,759

[22] Filed: Feb. 6, 1990

[51] Int. Cl.[5] ..... A41H 43/00

[52] U.S. Cl. ..... 248/451; 248/316.5; 211/13

[58] Field of Search ..... 248/316.7, 451, 316.1, 248/316.5, 451, 291, 309.1, 442.2; 40/611, 618; 211/13, 45; D3/26

[56] References Cited

U.S. PATENT DOCUMENTS

| | | | |
|---|---|---|---|
| 390,800 | 10/1888 | Palmer | 248/442.2 |
| 866,195 | 9/1907 | Dillman et al. | 248/316.5 |
| 1,972,802 | 9/1934 | Strack | 248/316.1 |
| 2,518,157 | 8/1950 | Malpas | 248/453 |
| 2,862,328 | 12/1958 | Wadsworth | 108/44 |
| 3,544,056 | 12/1970 | Berquist | 248/451 X |
| 3,955,722 | 5/1976 | Bard | D3/26 |
| 4,023,763 | 5/1977 | Pulley | 248/316.7 X |
| 4,243,335 | 1/1981 | Singley | 248/442.2 X |

*Primary Examiner*—Karen J. Chotkowski

[57] ABSTRACT

A light weight clipping device which has at one end a prong which attaches to an existing hoop bolt or to the scroll arm prong, which attaches to an existing scroll. A clip containing arms engaged with a tension device whereby a chart, book or page will be held; hooks for the attachment and removal of tools; a pad of foam for the attachment and removal of needles. The clipping device also maintains the stationary holding ability while allowing forward and reverse mobility for flexibly in viewing arrangement.

2 Claims, 5 Drawing Sheets

FIG.3-A
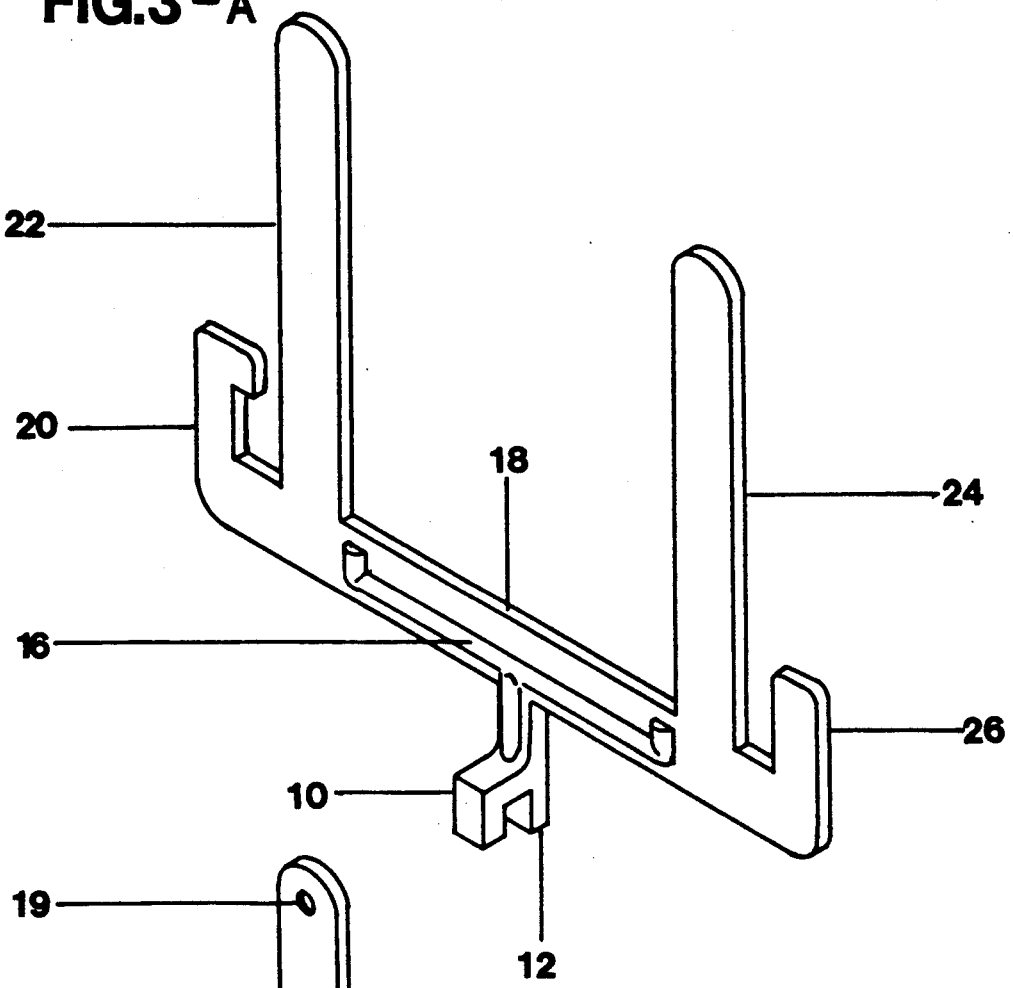
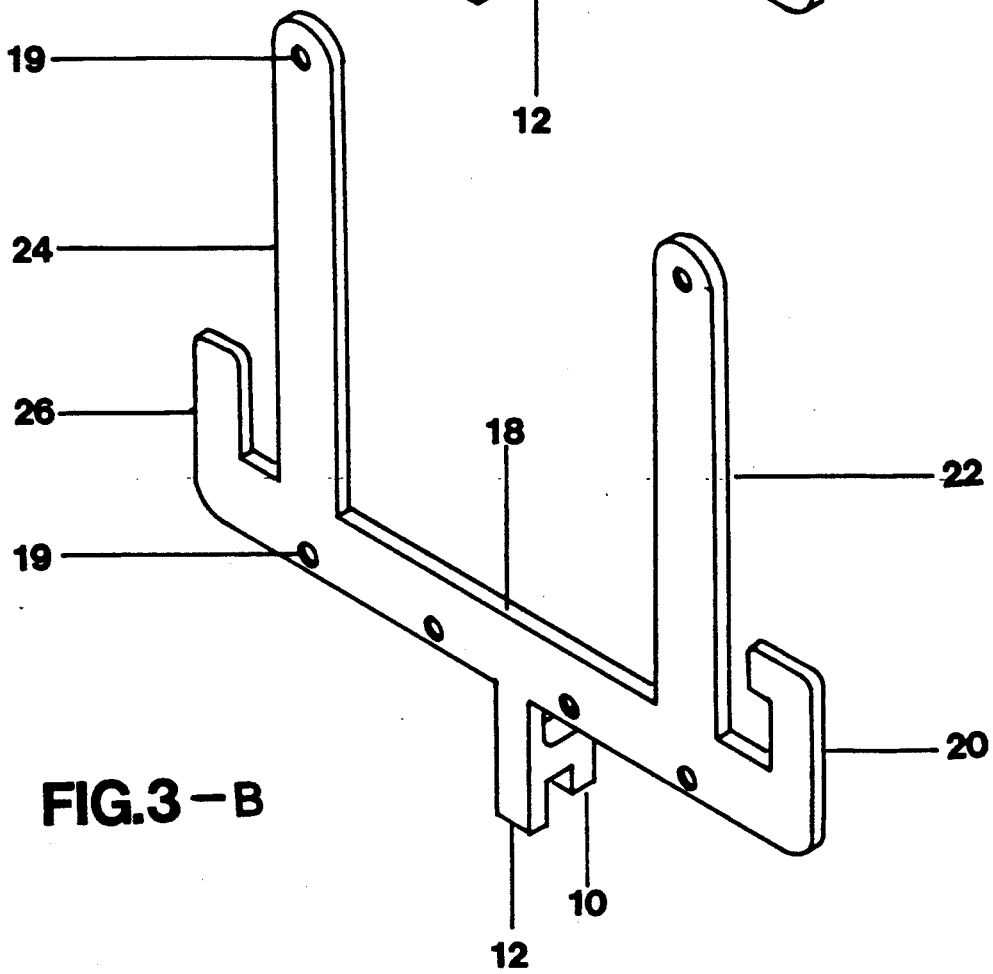
FIG.3-B

FIG.4 – A
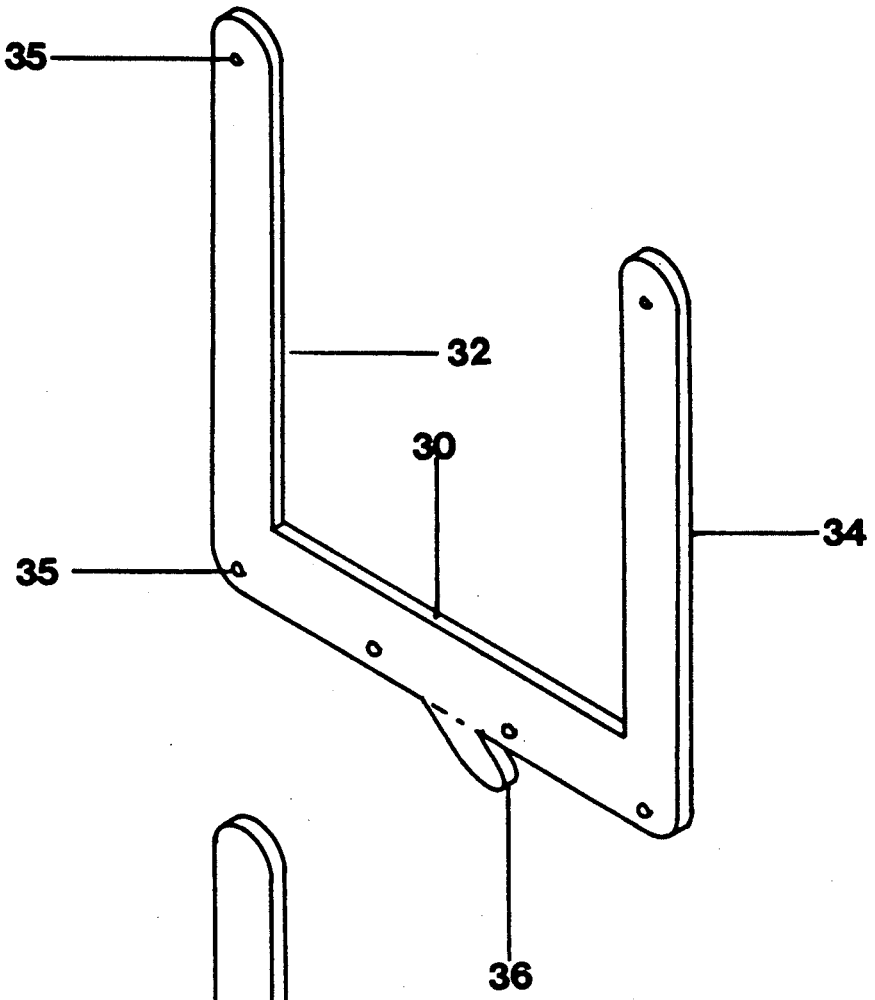
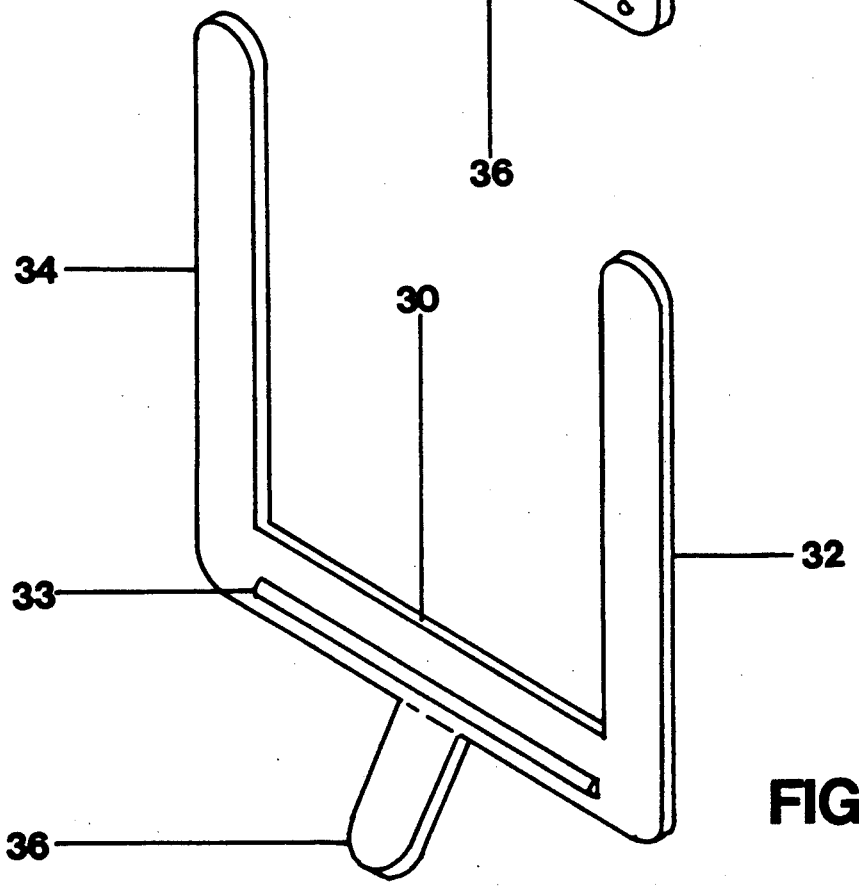
FIG. 4 – B

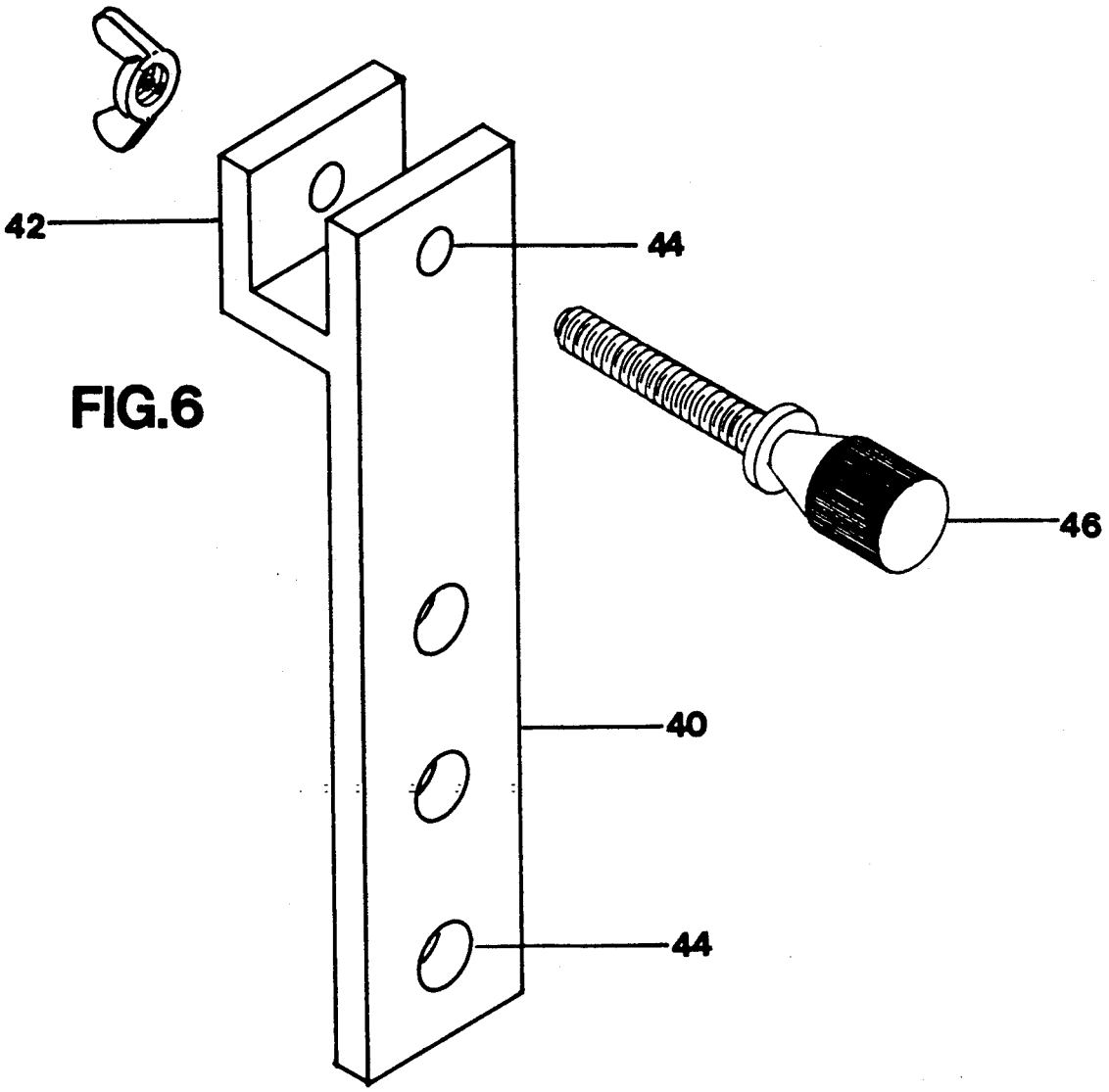
FIG.6
FIG.5
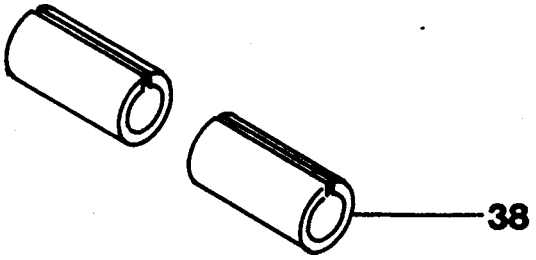

CHART CLIP

BACKGROUND

1. Field of Invention

This invention relates to a clip, specifically to a clip incorporating the function of a stationary attachment to an existing embroidery hoop or scroll while simultaneously providing accessible placement of existing charts and tools.

2. Description of Prior Art

Embroidery hoops have been used for many years to aid the handstitcher in his/her art. With the onset of low priced graphics stitchers are now able to purchase charts, by which they may follow a pre-set drawing on graph paper to re-create the art by their own hands.

To aid stitchers even more, scrolls and holders were designed, where-by allowing stitchers to stitch with greater ease and with both hands.

Consequently, the stitcher still faced the dilemma of how to best handle the stitching apparatus and read their graph simultaneously.

The foldable stand, in Dalbo, U.S. Pat. No. 4,483,505, and the book holder in Adler, U.S. Pat. No. 4,739,960 hold the chart, or book, but require a flat, stable surface in close proximity to the reader/stitcher to function properly.

As this field is limited, other prior art consists of a gripping device, Richardson, U.S. Pat. No. 4,662,039, and a clip, Takabayashi, U.S. Pat. No. 3,881,228. Neither device is capable of a stationary attachment, and were designed as simple clipping devices with many uses.

Also available is the Graph-Gripper, Peggy & Co., Peggy Winstead, Havelock, N.C., patent pending. This device was the first attempt to aid a stitcher explicitly. It does mount to an embroidery hoop, but its design precludes its use on a quilters hoop, which has a larger bolt size, or on a scroll, which has a more recessed bolt. Also, the Graph-Gripper is as its name states: a single-page graph gripper. It does not allow for a multi-paged graph to be inserted into its narrow slots; it contains nothing on which a stitcher may keep the necessary tools, such as scissors, thread or needles. A common problem among stitchers is lost thread and needles, and the constant hunting for a small pair of scissors in a sewing basket. Also, for it's design to function, it is molded of a brittle plastic. The arms are then cut from the flat body, and extended by heat. These arms contain sharp edges whereby graphs are torn from frequent insertion and removal. This type of plastic is brittle and should an arm be broken the device is rendered useless.

OBJECTS AND ADVANTAGES

Accordingly, besides the objects and advantages of the holders and clippers as described in my above patent, several objects and advantages of the present invention are:

(a) to provide a clipping device to contain a chart, book or page of multiple thicknesses;

(b) to provide a clipping device which will hold firmly without damaging the the object it contains;

(c) to provide a clipping device with arms to enable the easy attachment and removal of a number of utensils of the art;

(d) to provide a clipping device capable of safe, yet easy to use means for securing needles; stitcher slides pre-threaded needles into open-cell urethane foam pad.

(e) to provide a clipping device made of durable polystyrene plastic for safety, longevity, and lightness of weight;

(f) to provide a clipping device with smooth edges;

(g) to provide a clipping device for detachable attachment to supporting structures of various sizes;

(h) to provide a clipping device with a tight but undamaging clipping mechanism;

(i) to provide a clipping device capable of adjustment to appropriate angles by user.

Further objects and advantages are to provide a clipping device which can be used easily and conveniently, which is simple to use and inexpensive to manufacture.

BRIEF DESCRIPTION OF THE DRAWINGS

These and other features and advantages of the present invention will become apparent from the consideration of the following specification when taken in conjunction with the accompanying drawings in which:

FIG. 3 is a perspective view of the first plate member, inside and outside.

FIG. 4 is a perspective view of the second plate member, inside and outside.

FIG. 5 is a perspective view of the tension mechanism.

FIG. 6 is an enlarged perspective view of the scroll arm and accompanying bolt and nut.

Figure 1:
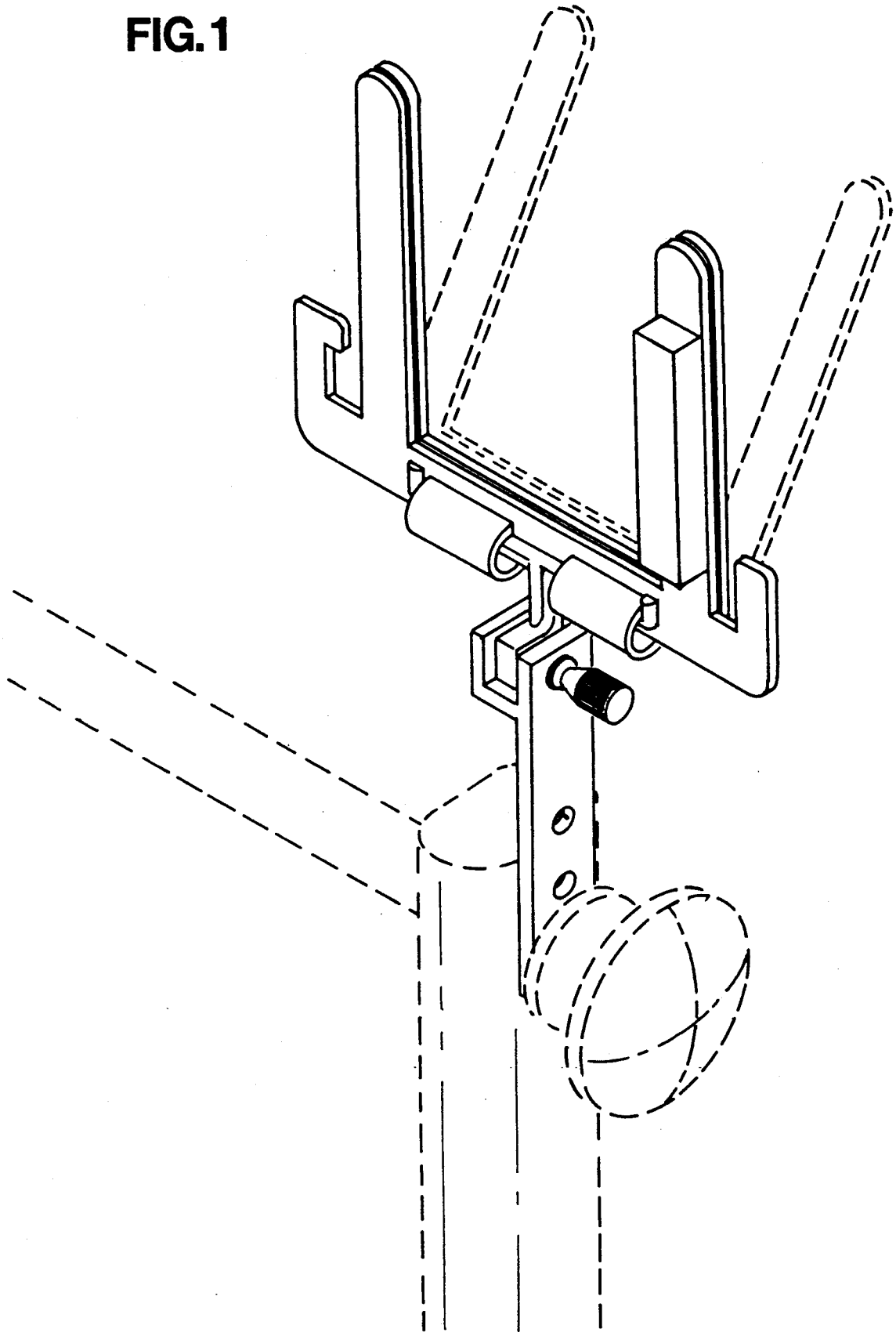
FIG. 1 shows the entire chart clip as it would function in conjunction with an existing scroll.

| Reference Numerals in Drawings | |
|---|---|
| 10 prong | 12 support member |
| 14 support ridge | 16 body ridge |
| 18 first plate-member body | 19 concavities |
| 20 curved hook | 22 left first arm |
| 24 right first arm | 26 straight hook |
| 28 needle pad | 30 second plate member body |
| 32 second left arm | 33 second body ridge |
| 34 second right arm | 35 convexities |
| 36 thumb tab | 38 tension device |
| 40 scroll support | 42 scroll prong |
| 44 aperture | 46 bolt |
| 48 nut | |

DESCRIPTION OF INVENTION

Referring now more particularly to the drawings and to that embodiment of the invention here presented by way of illustration it will be seen that:

FIG. 1 shows the entire chart clip as it would function in conjunction with an existing scroll.

Figure 2:
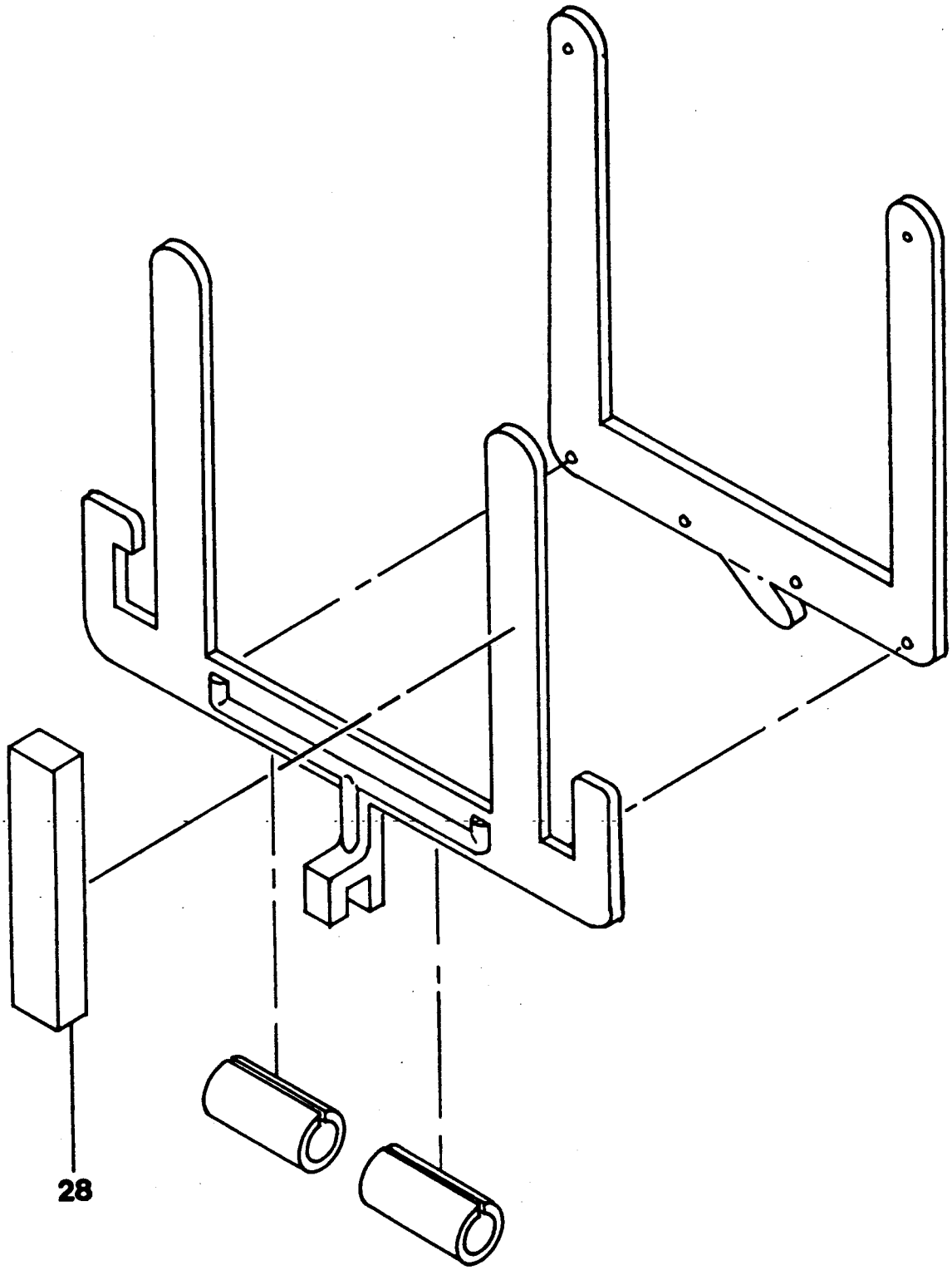
FIG. 2 is an isometric exploded view with a callout for the foam pad.

FIG. 2 shows, in an isometric, exploded view point: the first plate member and second plate member; foam pad 28, and tension devices 38.

FIG. 3 shows the first plate member as a flat body of injection molded polystyrene plastic consisting of a prong 10, a support member 12, a body 18, a curved hook 20, a left first arm 22, a right first arm 24, and a straight hook 26. Parallel with the horizontal upper edge of the front of body 12 is a body ridge 16 by which tension devices 38 are maintained in a fixed position. Centered on right first arm 24 is a rectangular needle pad 28 of open-cell urethane foam affixed by glue. On the inside of said first plate member is four concavities 19 referred to later in this description. On the inside top of the arch on arms 22 and 24 of first plate member are two, respectively, concavities 19 referred to later in this description. Prong 10 and support member 12, adapted to embrace and retain a structure such as a bolt. Support member 12 having a support ridge 14 vertically connecting with body ridge 16 for added stability.

FIG. 4 shows the second plate member as a flat body of injection molded polystyrene plastic consisting of a second body 30, a second left arm 32, a second right arm 34, and a thumb tab 36 connected to the lower portion of the second body 30. Parallel with the horizontal upper edge of the front of body 18 is a second body ridge 33 by which tension devices 38 are maintained in a fixed position. On the inside of said second plate member are four convexities 35 referred to later in this description. On the top of the arch on arms 32 and 34 of said second plate member are two, respectively, convexities 35 referred to later in this description.

FIG. 5 shows the tension mechanism consisting of two half inch sections of three eighths inch polyethylene tubing, 38, split lengthwise whereby enlisting the shaping memory of said tubing to provide clip with sufficient gripping ability. Such gripping ability enlisting the concavities 19 and convexities 35 of first and second plate members as a fulcrum.

FIG. 6 shows a perspective view of the scroll arm, injection molded of polystyrene plastic. Said scroll arm comprising of scroll support 40 and scroll prong 42. At the base of said scroll support 40 is aperture 44. Scroll support 40 having an opening adapted to fit the prong 10 of first plate member. Through which said aperture 44 is contained a bolt 46 and nut 48 for manual adjustment of angle of clip in FIG. 1.

SUMMARY, RAMIFICATIONS, AND SCOPE

Accordingly, the reader will see that the chart clip of this invention will be useful in a number of ways, and is not limited to one operation.

It will hold a chart, book or paper of a varied degree of thickness and pages firmly without damage, whereby maintaining original in good condition.

Its arms are of sufficient length to hold tall charts, books or pages, whereby eliminating the need to fold said objects into a small square.

It allows user to move a chart, book or page to the right or left without fear the said objects will fall out.

It allows user to adjust the angle, either forward or reverse, of the chart, book or page to their preference.

It provides the user with convenient arms for attaching and removing utensils.

It provides user with a safe holding place for needles, whereby saving user time by allowing for many different colors of thread to be pre-threaded and saves money by eliminating short threads that have to be discarded.

It provides the user with the ability to conform to different sizes of hoops.

It allows user to operate said clip on scrolls of different sizes.

What I claim is:

1. A clip capable of detachable attachment to a supporting structure, comprising:

(a) a first plate member having an elongated aperture, two vertical arms allowing sufficient opening so inserted materials are visible, a curved hook and a straight hook for tool attachment, and a rectangular pad of open-cell urethane foam for affixing needles, (b) a second plate member where-by said first plate member lays suitably juxtaposed, (c) a scroll arm having at one end a generally U shaped opening provided with an aperture by which a bolt can be attached, and at the bottom of said scroll arm apertures for connection to a supporting structure.

2. The tension clip contained in claim 1 enlisting as a tension providing device:

(a) a memory retentive clipping device, where-by said clip will contain gripping ability.

* * * * *